US012287185B2

(12) United States Patent
Song et al.

(10) Patent No.: US 12,287,185 B2
(45) Date of Patent: Apr. 29, 2025

(54) ARROW SHAFT

(71) Applicant: SHINKWANG LEPORTS CO., LTD, Busan (KR)

(72) Inventors: Yun Il Song, Busan (KR); Yun Sub Song, Busan (KR); Yoon Jae Song, Busan (KR)

(73) Assignee: SHINKWANG LEPORTS CO., LTD, Busan (KR)

( * ) Notice: Subject to any disclaimer, the term of this patent is extended or adjusted under 35 U.S.C. 154(b) by 191 days.

(21) Appl. No.: 18/199,981

(22) Filed: May 22, 2023

(65) Prior Publication Data

US 2024/0393091 A1 Nov. 28, 2024

(51) Int. Cl.
*F42B 6/04* (2006.01)

(52) U.S. Cl.
CPC ..... *F42B 6/04* (2013.01)

(58) Field of Classification Search
CPC ..... F42B 6/02; F42B 6/04
See application file for complete search history.

(56) References Cited

U.S. PATENT DOCUMENTS 6,758,773 B1 * 7/2004 Liao ..... F42B 6/003 473/578
6,866,599 B2 * 3/2005 Eastman, II ..... F42B 6/04 473/578
7,201,818 B2 * 4/2007 Eastman, II ..... F42B 6/04 156/172
8,579,739 B2 * 11/2013 Song ..... F42B 6/04 473/578
9,194,671 B1 * 11/2015 Song ..... F42B 6/04
10,907,942 B2 * 2/2021 Greenwood ..... F42B 6/04
2003/0073524 A1 * 4/2003 Song ..... F42B 6/04 473/578
2006/0084534 A1 * 4/2006 Flowers ..... F42B 6/04 473/578
2017/0321999 A1 * 11/2017 Hoefer ..... B29C 63/0073

FOREIGN PATENT DOCUMENTS

KR 10-2002-0057554 A 7/2002

* cited by examiner

*Primary Examiner* — John A Ricci
(74) *Attorney, Agent, or Firm* — Revolution IP, PLLC

(57) ABSTRACT

Proposed is an arrow shaft, having an arrowhead on one side thereof and a nock on the other side thereof, the arrow shaft including: at least one sheet layer arranged in one direction to be wound in a stacked manner around at least one portion of a body of the arrow shaft, wherein the sheet layer comprises a first sheet member, at least one portion thereof including a plurality of sheet portions formed of a transparent or translucent material; a second sheet member, at least one portion thereof being formed to overlap the first sheet member; and an exposure sheet portion interposed between the first sheet member and the second sheet member.

6 Claims, 4 Drawing Sheets

[FIG. 1]
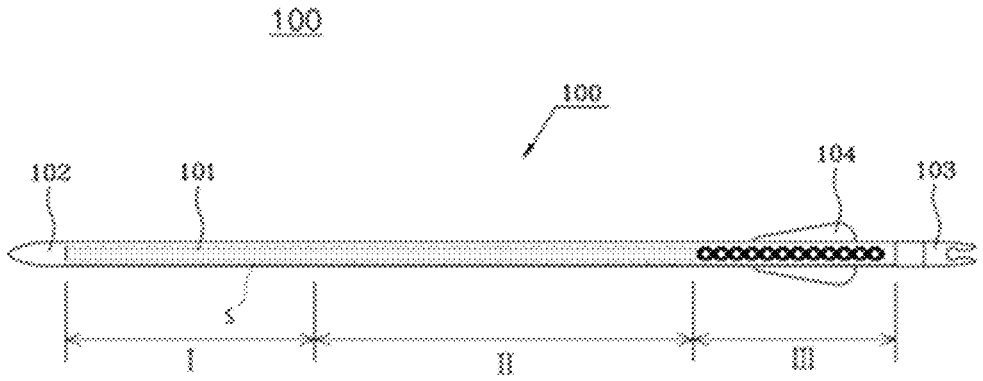
[FIG. 2]
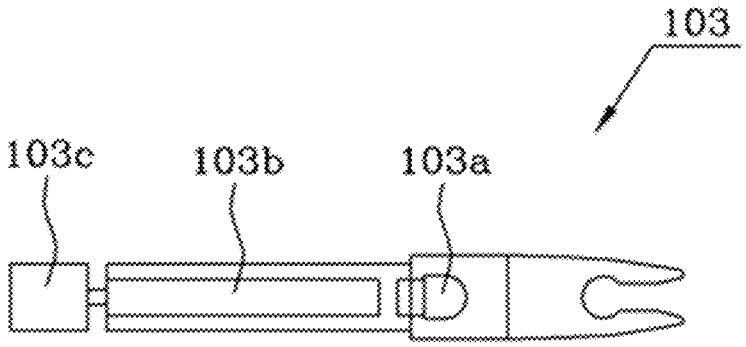
[FIG. 3]
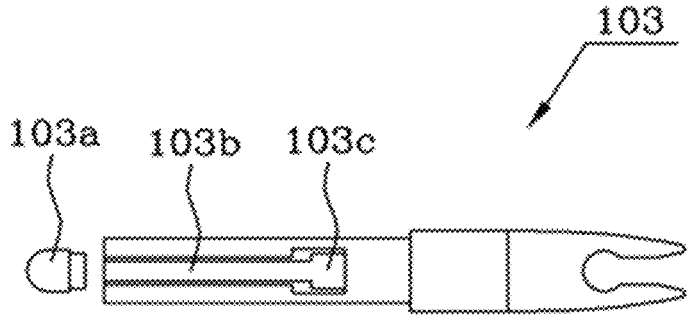

[FIG. 4]
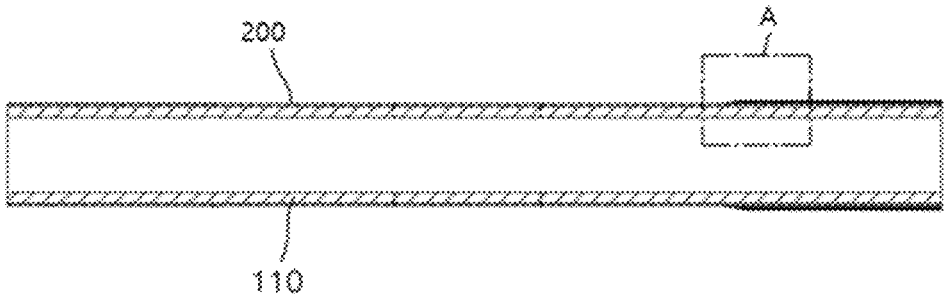
[FIG. 5]
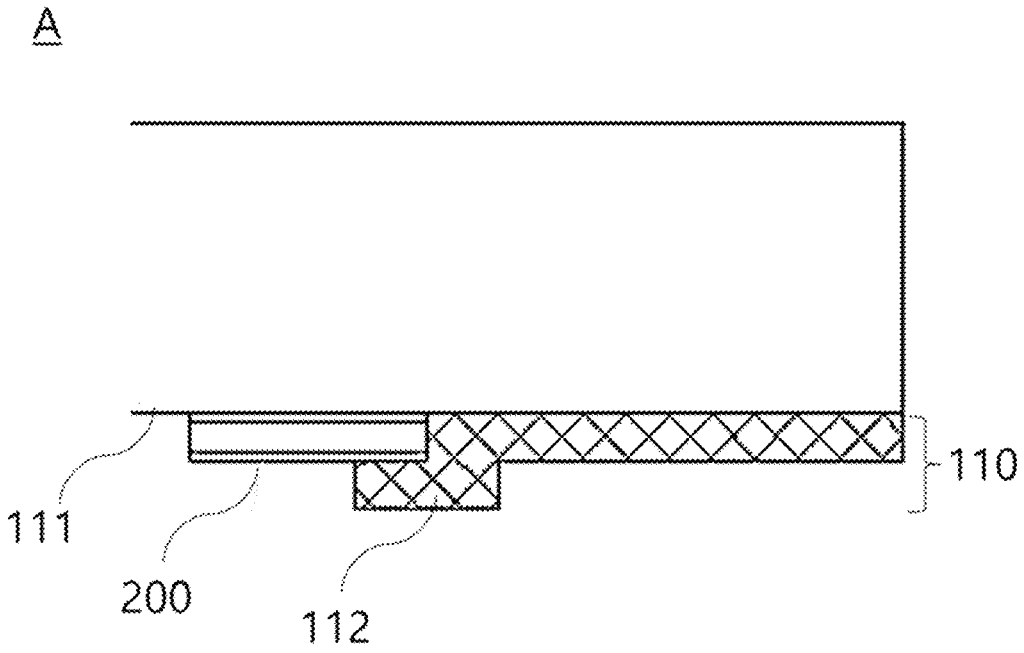

[FIG. 6]
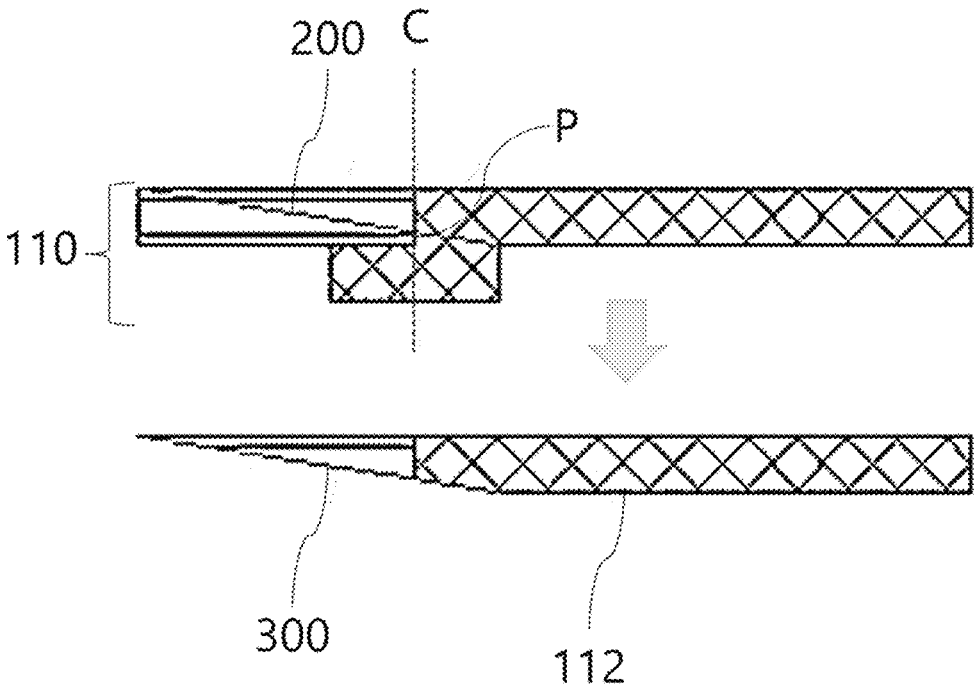

[FIG. 7]
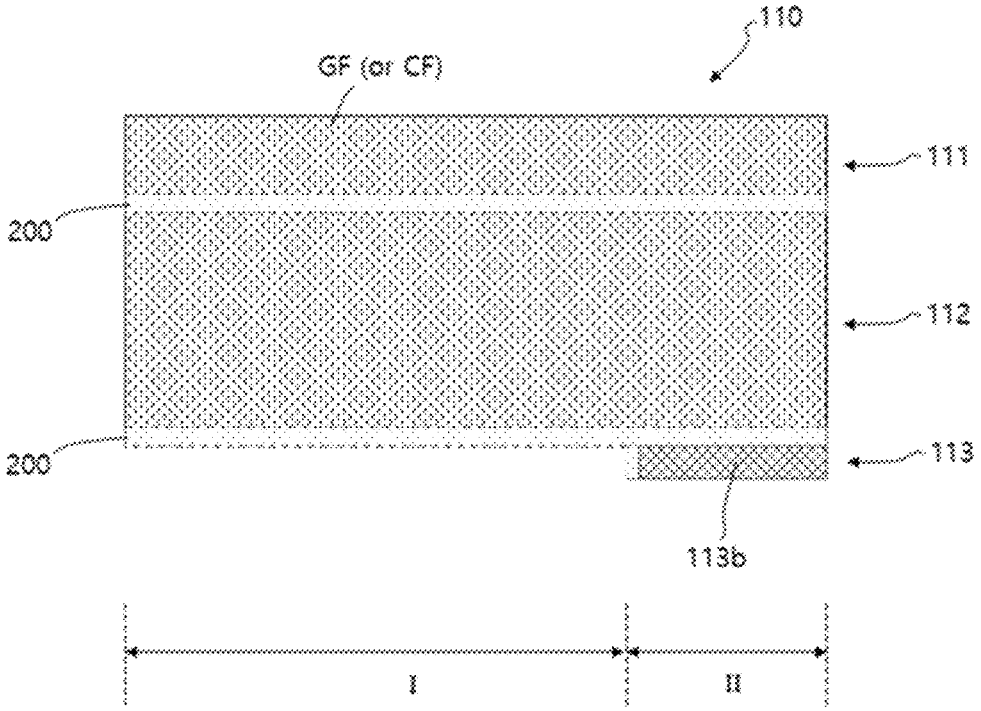

ARROW SHAFT

TECHNICAL FIELD

The present disclosure relates to an arrow shaft that has aesthetic appeal and high strength.

BACKGROUND ART

Normally, an arrow is configured to include an arrow shaft in the shape of a hollow cylinder, an arrowhead mounted on a front end portion of the arrow shaft, a nock mounted on a rear end portion of the arrow shaft, and feathers attached on a rear outer circumferential surface of the arrow shaft.

In a case where the arrow is successively shot many times, a paradox phenomenon has a considerable influence on the arrow shaft. The arrow shaft in flight is bent toward a pressure point (the center of gravity) and thus to a shape similar to that of a bow, while a flight direction thereof is changed many times. When the arrow shaft continuously undergoes this phenomenon, a middle portion of the arrow shaft where the center of gravity of the arrow shaft is positioned may be deformed or damaged.

At the moment the arrow is shot from the bow, the archer's paradox phenomenon occurs. At this point, strength, weight, length, and the like of the arrow shaft are not so suitable as to correspond to strength of the bow, the arrow will not fly straight forward.

Normally, that a force of a middle of the arrow is great means that strength of the arrow, that is, the force of the middle of the arrow is great when compared with the strength of the bow. Moreover, that the force of the middle of the arrow is small means that the strength of the arrow is low when compared with the strength of the bow.

Therefore, in order to measure the strength of the arrow shaft, a weight is hung from the center of the arrow shaft. Then, the degree to which the arrow shaft is bent is measured. Accordingly, an arrow shaft that is so suitable as to correspond to the strength of the bow is selected. The degree to which the arrow shaft is bent is referred to as spine strength.

An increase in the spine strength of the arrow shaft provides the advantage that the degree to which the arrow shaft is deformed due to straight flying of the arrow and a frequently occurring paradox phenomenon is reduced. Because the spine of the arrow has to be determined taking into consideration the strength of the bow. The unconditional increase in the spine strength of the arrow shaft is not necessarily advantageous and causes the problem of increasing the material cost and the manufacturing cost.

The arrow shaft experiences an external force that varies with a position thereof in a lengthwise direction of the arrow shaft. That is, the middle portion of the arrow shaft frequently experiences warping due to the paradox phenomenon as described above. Therefore, the use of the arrow shaft for a long period of time makes the arrow shaft fragile. When the arrow is frequently shot, a front portion of the arrow shaft with which an arrowhead is combined experiences a great shock at the moment it is hit on a target. In contrast, a rear portion of the arrow shaft with which the nock is combined experiences a great shock applied by a bowstring.

Portions of the arrow shape need to have different elasticity, strength, and other properties that are required according to their respective positions in the lengthwise direction of the arrow shaft. Therefore, when manufacturing the arrow shaft, the portions of the arrow shaft need to be formed of materials that vary in property according to positions of the portions. However, there is a problem in that an arrow shaft in the related art that is formed of a single material does not satisfy this need.

DESCRIPTION OF THE RELATED ART

Document of Related Art (Patent Document) Korean Patent Application Publication No. 2002-0057554 (Jul. 11, 2002)

SUMMARY OF INVENTION

Technical Problem

An object of the present disclosure is to provide an arrow shaft in which a transparent layer is formed on overlapping portions of a plurality of sheet layers wounded in a stacked manner around a cylindrical body of the arrow shaft. With this configuration, the arrow shaft is capable of preventing a machined surface of the sheet layer from being exposed during machining.

Another object of the present disclosure is to provide an arrow shaft in which a strength-reinforcing portion is formed on overlapping portions of a plurality of sheet layers wounded in a stacked manner around a cylindrical body of the arrow shaft. With this configuration, the arrow shaft is capable of having high strength.

A present disclosure is not limited to the objects mentioned above. From the following detailed description, an object not mentioned above would be clearly understandable by a person of ordinary skill in the art.

Solution to Problem

In order to accomplish the above-mentioned objects, there is provided an arrow shaft, having an arrowhead on one side thereof and a nock on the other side thereof, the arrow shaft including: at least one sheet layer arranged in one direction to be wound in a stacked manner around at least one portion of a body of the arrow shaft, wherein the sheet layer comprises a first sheet member, at least one portion thereof including a plurality of sheet portions formed of a transparent or translucent material; a second sheet member, at least one portion thereof being formed to overlap the first sheet member; and an exposure sheet portion interposed between the first sheet member and the second sheet member.

In the arrow shaft, at least one part of the exposure sheet portion may be exposed by being polishing-machined, but in such a manner that a horizontal section thereof is formed parallelly in a lengthwise of the arrow shaft.

In the arrow shaft, the exposure sheet portion may be polishing-machined in such a manner that the first sheet member and at least one portion of the second sheet member are kept as formed.

In the arrow shaft, the sheet layer may include at least one of a carbon fiber and a glass fiber.

In the arrow shaft, the body of the arrow shaft may be formed as a straight portion and a fabric sheet for enhancing adhesive strength may be interposed between each of the straight portion, the sheet layer, and the exposure sheet portion.

In the arrow shaft, at least one of the sheet layer and the exposure seat portion adheres with a thermal transfer process.

From the following detailed description and the accompanying drawings, an embodiment not mentioned would be derived by a person of ordinary skill in the art.

Advantageous Effects of Invention

According to an arrow shaft according to the present disclosure, a transparent layer is formed on overlapping portions of a plurality of sheet layers wounded in a stacked manner around a cylindrical body of the arrow shaft. Thus, the arrow shaft can prevent a machined surface of the sheet layer from being exposed during machining.

According to the arrow shaft according to the present disclosure, a strength-reinforcing portion is formed on overlapping portions of a plurality of sheet layers wounded in a stacked manner around a cylindrical body of the arrow shaft. Thus, the arrow shaft can have high strength.

The present disclosure is not limited to the above-mentioned effects. From the following claims, an effect not mentioned above would be clearly understandable by a person of ordinary skill in the art.

BRIEF DESCRIPTION OF DRAWINGS

FIG. 1 is a view illustrating a configuration of an exterior appearance of an arrow according to a desired embodiment of the present disclosure.

FIGS. 2 and 3 are cross-sectional views of a nock, each illustrating a structure of a light emitting unit that is mounted on an arrow shaft according to the present disclosure.

FIG. 4 is a schematic cross-sectional view of an arrow according to an embodiment of the present disclosure.

FIG. 5 is a partial cross-sectional view illustrating a portion A of FIG. 4.

FIG. 6 is a view illustrating a state where an exposure sheet portion of the arrow according to the embodiment of the present disclosure is formed.

FIG. 7 is a view illustrating a state where an arrow-shaft formation sheet is spread out.

DESCRIPTION OF EMBODIMENTS

An embodiment of the present disclosure will be described in detail below with reference to the accompanying drawings. It should be noted that, in assigning a reference numeral to a constituent element that is illustrated in the drawings, the same constituent element, although illustrated in different drawings, is designated by the same reference numeral, if possible, throughout the drawings. In addition, a specific description of a well-known configuration or function that is associated with the embodiment of the present disclosure will be omitted when determined as making the nature and gist of the present disclosure obfuscated.

The ordinal numbers, first, second, and so forth, the letters in upper case A, B, and so forth, and the parenthesized letters in lower case, (a), (b), and so forth may be used to name a constituent element according to the embodiment of present disclosure. These ordinal numbers and letters are used only to distinguish among the same constituent elements, and do not impose any limitation on the natures of the same constituent elements or the order thereof. Unless otherwise defined, all terms including technical or scientific terms, which are used in the present specification, have the same meanings as are normally understood by a person of ordinary skill in the art to which the present disclosure pertains. The term as defined in a dictionary in general use should be construed as having the same meaning as interpreted in context in the relevant technology, and, unless otherwise explicitly defined in the present specification, is not construed as having a prototypical meaning or an excessively literal meaning.

A high-strength arrow shaft according to an embodiment of the present disclosure will be described below with reference to the accompanying drawings.

FIG. 1 is a view illustrating a configuration of an exterior appearance of an arrow 100 according to a desired embodiment of the present disclosure. The arrow 100 according to the desired embodiment of the present disclosure includes a hollow arrow shaft 101. The arrow shaft 101, as illustrated, is defined as having a front end portion with which an arrowhead 102 is combined and a rear end portion with which a nock 103 is combined. That is, the arrow shaft 101 has a front portion I, a middle portion II, and a rear portion III along the lengthwise direction thereof from the front end portion to the rear end portion. Reference number 104 in the drawings depicts feathers of the arrow 100 that are not described.

The rear portion III of the arrow shaft 101 according to the embodiment of the present disclosure, which is illustrated in the drawings, is formed of a transparent or translucent material, and a nock 103 is combined with a rear end portion of the rear portion III. FIGS. 2 and 3 are cross-sectional views of the nock 103, each illustrating a structure of a light emitting unit that is mounted on the arrow shaft 101 according to the present disclosure.

The light emitting unit in FIG. 2 has a structure that is usually employed in the related art. A light source 103*a*, such as an LED, is mounted in the light emitting unit in a manner that is adjacent to an inside portion of the nock 103 that holds a bowstring firmly in place. A battery 103*b* is mounted in the light emitting unit in a manner that is slidable along the lengthwise direction of the nock 103 inside the nock 103. A switch 103*c* is formed, in a manner that is connected to the battery 103*b*, to the opposite side of the battery 103*b* connected to the light source 103*a*.

The battery 103*b* is usually spaced away from the light source 103*a* in a manner that is not brought into contact therewith. When the nock 103 is securely attached to the bowstring, the switch 103*c* and the battery 103*b* are slid to the right side and thus are brought into electric contact with the light source 103*a*, thereby turning on the light source 103*a*. In this case, the switch 103*c* is fixedly mounted on a wall of an inner circumferential surface of the arrow shaft 101.

Positions of the light source 103*a* and the switch 103*c* in a light emitting structure illustrated in FIG. 3 are opposite to positions thereof, respectively, in the light emitting structure described above. That is, instead of being mounted inside the nock 103, the light source 103*a* is positioned outside the nock 103 and is fixedly mounted on the wall of an inner circumferential surface of the arrow shaft 101. Then, the battery 103*b* and the switch 103 connected to the battery 103*b*, as illustrated, are mounted inside the nock 103 in a manner that is slidable in a leftward-rightward direction.

With this structure, even when the nock 103 is securely attached to the bowstring, the light source 103*a* is not turned on. At the moment an arrow is shot toward a target, with an inertia force, the switch 103*c* and the battery 102*b* are slid toward the front of the arrow shaft 101 and thus are brought in electric contact with the light source 103*a*, thereby turning on the light source 103*a*.

According to the present disclosure, since the rear portion III of the arrow shaft 101 is formed of a transparent or translucent material, light is emitted from inside the nock 103 to the outside and also through the arrow shaft 101. Thus, the effect is that the visibility of the arrow shaft 101 from a remote distance during the night can be improved.

The above-mentioned implementation example of the structure of the light emitting unit serves only the purpose of describing the present disclosure. A structure of any well-known light emitting unit in the related art may be employed as the structure of the light emitting unit according to the embodiment of the present disclosure.

FIG. 4 is a schematic cross-sectional view of the arrow 100 according to the embodiment of the present disclosure. FIG. 5 is a partial cross-sectional view illustrating a portion A of FIG. 4. FIG. 6 is a view illustrating a state where an exposure sheet portion 200 of the arrow 100 according to the embodiment of the present disclosure is formed.

With reference to FIGS. 4, 5, and 6, the high-strength arrow shaft 101 according to the present disclosure, having the arrowhead 102 on one side thereof and the nock 103 on the other side thereof, may include at least one sheet layer 110 arranged in one direction to be wound in a stacked manner around at least one portion of a body of the arrow shaft 101. The sheet layer 110 may include a first sheet member 111, at least one portion thereof including a plurality of sheet portions formed of a transparent or translucent material, a second sheet member 112, at least one portion thereof being formed to overlap the first sheet member 111, and an exposure sheet portion 200 interposed between the first sheet member 111 and the second sheet member 112. In this case, the exposure sheet portion 200 may be arranged between the first sheet member 111 and the second sheet member 112, and one portion thereof may be exposed in a process of polishing the arrow shaft 101. Thus, a mark, such as a stain, that occurs on a machined surface or an adhesion surface may be hidden from view.

Specifically, the exposure sheet portion 200 of the high-strength arrow shaft 101 according to the present disclosure, as illustrated in FIGS. 5 and 6, may be machined along a machining line 300. At this point, an overlapping point P may be formed at a stepped end of the second sheet member 112 formed in a stacked manner on the first sheet member 111. That is, while the process of polishing the arrow shaft 101 with respect to an imaginary vertical line C passing through the overlapping point P is performed, the exposure sheet portion 200 is machined in such a manner as to be exposed. Thus, a cellophane mark or the like that may appear on the machined surface, or the adhesion layer may be prevented from being exposed.

FIG. 7 is a view illustrating a state where an arrow-shaft formation sheet 100 is spread out. The arrow shaft 101, as illustrated, is formed from the arrow-shaft formation sheet 110. The arrow shaft 101 is manufactured in the following sequence: a process of cutting the arrow-shaft formation sheet 110 to a predetermined length, a process of winding the arrow-shaft formation sheet 110 in a stacked manner, a taping process, a heat treatment and cooling process, a mandrel removing process, and a polishing process.

The arrow-shaft formation sheet 110 is formed from an elastic sheet, such as a carbon fiber sheet or a glass fiber sheet, or is formed from a combination of non-elastic sheets, such as fiber sheets which a camouflage pattern is printed on or is transferred to.

The arrow-shaft formation sheet 110 according to the present embodiment includes a first sheet layer 111, a second sheet layer 112 that is a lowermost layer, that is a middle layer, and a third sheet layer 113 that is an uppermost layer. The first sheet layer 111 is formed by successively arranging a multiplicity of carbon fibers CF or a multiplicity of glass fiber GF in a parallel manner in one direction (a longitudinal direction in the drawings). The second sheet layer 112 is formed by successively arranging the multiplicity of glass fiber GF in a parallel manner in the other direction (a transverse direction in the drawings).

The exposure sheet portion 200 may be formed between connection portions of the first sheet layer 111 and the second sheet layer 112 that is a middle layer, and between connection portions of the second sheet layer 112 and the third sheet layer 113 that is an uppermost layer in a manner that is exposed at each of the overlapping portions of the first, second, and third sheet layers 111, 112, and 113. In addition, the exposure sheet portion 200 may also be formed between connection portions of a front sheet 113*a* and a rear sheet 113*b* of the third sheet layer 113 in a manner that is exposed at each of the overlapping portions of the front and rear sheets 113*a* and 113*b*.

The arrow shaft 101 may be formed by winding the arrow-shaft formation sheet 110 around a bar-shaped metal mandrel and then performing the above-mentioned processes. Each of the first, second and third sheets 111, 112, and 113 may be formed by prepreg-treating a multiplicity of carbon fibers or glass fibers, or carbon fiber fabrics as a prepreg. That is, each of the first, second and third sheets 111, 112, and 113 is manufactured by impregnating the multiplicity of carbon fibers with epoxy resin, polyester resin, thermoplastic resin, or the like.

One exposure sheet portion 200 that is exposed at the machined surface may connect the first sheet layer 111 and the second sheet layer 112 to each other, and the other exposure sheet portion 200 that is exposed at the machined surface may connect the second sheet layer 112 and the third sheet layer 113 to each other. Therefore, the arrow-shaft formation sheet 110 according to the present disclosure is formed into one sheet of which the first sheet layer 111, the second sheet layer 112, and the third sheet layer 113 form the exposure sheet portion 200 that is exposed at the machined surface.

An elastic sheet, such as a carbon fiber sheet or a glass fiber sheet, or a non-elastic sheet formed by prepreg-treating a natural or synthetic fiber, is used as a material of which the arrow shaft 101 is manufactured. In most cases, a carbon fiber sheet may be used as the material thereof. A carbon fiber sheet and glass fiber sheet vary in type from one application to another. Moreover, the carbon fiber sheet and glass fiber sheet vary in tensile strength, elastic modulus, elongation, weight, and density from one type to another and from one model to another.

A tonnage of a carbon fiber or glass fiber prepreg sheet means a weight of the carbon fiber or glass fiber prepreg sheet that has a length of 1 mm and a width of 1 mm. For example, 24 tons of the carbon fiber sheet is indicated by 24 $TON/mm^2$. Therefore, the more increased the tons of the carbon fiber sheet, the higher strength a high-elasticity sheet has. Therefore, a tonnage of the carbon fiber sheet, and spine strength and elastic strength of the tonnage of the carbon fiber sheet, which are defined as having the same meaning, are used.

The prepreg-treated carbon fiber sheet and glass fiber sheet (hereinafter referred to simply as the carbon sheet and glass fiber sheet, respectively) vary in type. Various models of the carbon sheet and the glass fiber sheet that range from models having normal elasticity to models having high elasticity are manufactured and vary in tensile strength, elastic modulus, tensile modulus, elongation rate, mass per unit length, and density per unit length according to elasticity.

Usually, when it is assumed that the carbon fiber sheet or the glass fiber sheet has the same thickness, the more increased the number of carbon fibers or glass fibers arranged per unit area, or the more increased the weight of the carbon fibers or the glass fibers, the more excellent elasticity strength the carbon fibers or the glass fibers have.

In addition, a carbon fiber fabric or glass fiber fabric that is formed by weaving the carbon fibers or glass fibers, respectively, which are arranged in different directions, in a crossing manner has the advantage of having higher elastic strength and being less split than a sheet formed by only the carbon fibers or glass fibers that are arranged in one direction.

The first sheet layer 111 is a lowermost layer that is attached on a mandrel by being brought into direct contact therewith. The first sheet layer 111 may be formed as a relatively low-elasticity carbon fiber sheet or glass fiber sheet. In a case where the first sheet layer 111 is formed as the glass fiber sheet, the transparency of the arrow shaft 101 may be improved.

The second sheet layer 112 may be connected to the first sheet layer 111 in such a manner that the first sheet layer 111 and the glass fiber GF are arranged to be orthogonal to each other. The third sheet layer 113 has three portions in a lengthwise direction of the arrow shaft 101. The three portions may be formed of different carbon fiber sheets or glass fiber sheets.

For a first region I of the arrow shaft 101, a sheet in which the carbon fiber CF is arranged more densely than the second sheet layer 112 is selected as the front sheet 113*a*, and for a second region II, a transparent or translucent sheet formed by prepreg-treating the glass fiber using epoxy resin or the like is selected as the rear sheet 113*b*. At this point, it is possible that the rear sheet 113*b* is formed in such a manner as to have lower or higher strength than the front sheet 113*a* by adjusting the density or the like of the glass fiber.

Of course, according to need, the first region 1 and the second region II may be formed to have different strengths than the front sheet 113*a* and the rear sheet 113*b*.

According to the present embodiment, when an entire length of the arrow shaft 101 is assumed to be 100, for example, the first region I and the second region II may be formed in such a manner that a length of the first region I and a length of the second region II account for 50% to 70% and 30% to 50%, respectively, of the entire length of the arrow shaft 101. However, there is no need to manufacture the arrow shaft 101 according to these percentages. These percentages may be changed or adjusted whenever needed.

When the arrow shaft 101 is configured as described so far, the entire strength of the arrow shaft 101 may be reinforced. Thus, the arrow shaft 101 may be prevented from being damaged and deformed due to repeated shock and a paradox phenomenon. Moreover, the front portion I and the rear portion II of the arrow shaft 101 may be prevented from being deformed or damaged due to frequent shooting of the arrow 100.

Furthermore, the portions of the arrow shaft 101 may have different elasticity and spine strength that are required according to their respective positions. Thus, the flight stability of the arrow 100 or the ability of the arrow 100 to fly along a straight line may be enhanced.

At least one of the first, second, third seat layers 111, 112, 113 and the exposure seat portion 200 may have a structure in which adhesion is possible with a thermal transfer process of performing transferring and attaching by applying constant temperature and pressure or may have a structure in which a fabric sheet for enhancing adhesive strength is interposed.

A process of manufacturing the arrow shaft 101 from the arrow-shaft formation sheet 110 described above is described as follows.

First, a release material is applied to an entire out circumferential surface of the mandrel (not illustrated) in order to remove the mandrel, and then an adhesive is applied to the removal material. The arrow-shaft formation sheet 110 that is cut to a predetermined length and is prepreg-treated is wound around the outer circumferential surface of the mandrel. Specifically, the first sheet layer 111 that is an end portion of the arrow-shaft formation sheet 110 is adhesively attached to a surface of the mandrel. Then, a rolling apparatus (not illustrated) winds the arrow-shaft formation sheet 110 around the mandrel in a stacked manner. This winding by the rolling apparatus is referred to as a rolling process.

A taping apparatus (not illustrated) winds a film around the outermost surface of the stack body on the mandrel. This winding by the taping apparatus is referred to as a taping process. It is desired that a PET film or an OPP film is used as the film to be wound around the outermost surface of the arrow-shaft formation sheet 110. In order to discharge air remaining between each of the sheet layers and to stack the arrow-shaft formation sheet 110 more tightly stacked on the mandrel, the taping process is performed before forming a semi-finished product that undergoes the rolling process.

Subsequently, the stack body on the mandrel that is taped is formed into shape by being heated at varying temperature for a predetermined time, and then the mandrel is removed. The desired temperature for forming the stack boy into shape ranges from 80 to 150° C., and the suitable heating time ranges from approximately one to four hours.

Lastly, both end portions of the arrow shaft 101 are cut to, for example, a length of approximately 825 mm. After the film is removed, an outer circumferential surface of a main body of the arrow shaft 101 is polished by performing a centerless polishing process. At this point, when the polishing process is performed on the exposure sheet portion 200 of the main body of the arrow shaft 101 in such a manner as to expose the exposure sheet portion 200, the cellophane mark or the adhesion surface that may be exposed during the process of polishing the arrow shaft 101 may be covered with the exposure sheet portion 200. Therefore, the arrow shaft 101 according to the present embodiment that has aesthetic appeal and high strength in the lengthwise direction of the arrow shaft 101 due to the presence of the exposure sheet portion 200 is manufactured.

It would be understood by a person of ordinary skill in the art that the present disclosure pertains to that the present disclosure can be practiced in the form of other specific forms without changing the technical idea and essential features thereof. Therefore, in every aspect, the embodiment described above should be understood as being exemplary and non-restrictive. Accordingly, the scope of the present disclosure should be defined by the following claims without being limited to the described embodiment. All modifications or alterations that are derived from claim languages and their equivalents should be interpreted as falling within the scope of the present disclosure.

What is claimed is:

1. An arrow shaft, having an arrowhead on one side thereof and a nock on the other side thereof, the arrow shaft comprising:

at least one sheet layer arranged in one direction to be wound in a stacked manner around at least one portion of a body of the arrow shaft, wherein the sheet layer comprises:

a first sheet member, at least one portion thereof including a plurality of sheet portions formed of a transparent or translucent material;

a second sheet member, at least one portion thereof being formed to overlap the first sheet member; and an exposure sheet portion interposed between the first sheet member and the second sheet member.

2. The arrow shaft of claim 1, wherein at least one part of the exposure sheet portion is exposed by being polishing-machined, but in such a manner that a horizontal section thereof is formed parallelly in a lengthwise direction of the arrow shaft.

3. The arrow shaft of claim 2, wherein the exposure sheet portion is polishing-machined in such a manner that the first sheet member and at least one portion of the second sheet member are kept as formed.

4. The arrow shaft of claim 1, wherein the sheet layer includes at least one of a carbon fiber and a glass fiber.

5. The arrow shaft of claim 1, wherein the body of the arrow shaft is formed as a straight portion and wherein a fabric sheet for enhancing adhesive strength is interposed between each of the straight portion, the sheet layer, and the exposure sheet portion.

6. The arrow shaft of claim 1, wherein at least one of the sheet layer and the exposure sheet portion adheres with a thermal transfer process.

* * * * *